US008020854B2

(12) United States Patent
Hayakawa

(10) Patent No.: US 8,020,854 B2
(45) Date of Patent: Sep. 20, 2011

(54) SHEET FEEDING APPARATUS, IMAGE PROCESSOR AND SHEET FEEDING METHOD

(75) Inventor: Yuji Hayakawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/507,448

(22) Filed: Jul. 22, 2009

(65) Prior Publication Data

US 2010/0123283 A1 May 20, 2010

(30) Foreign Application Priority Data

Nov. 18, 2008 (JP) ..... 2008-294511

(51) Int. Cl.
*B65H 1/00* (2006.01)

(52) U.S. Cl. ..... 271/171; 271/144

(58) Field of Classification Search ..... 271/143, 271/144, 9.09, 171, 145
See application file for complete search history.

(56) References Cited

U.S. PATENT DOCUMENTS

| | | | | |
|---|---|---|---|---|
| 1,136,034 | A * | 4/1915 | Myers | 271/160 |
| 3,592,463 | A * | 7/1971 | Bonnema et al. | 271/14 |
| 3,862,753 | A * | 1/1975 | Giorgini | 271/171 |
| 4,284,269 | A * | 8/1981 | Ignatjev | 271/122 |
| 4,570,757 | A * | 2/1986 | Marzullo | 188/67 |
| 4,907,792 | A * | 3/1990 | Washiashi et al. | 271/240 |
| 5,611,528 | A * | 3/1997 | Nakamura et al. | 271/164 |
| 5,931,456 | A * | 8/1999 | Laidlaw | 271/171 |
| 6,073,925 | A * | 6/2000 | Sato | 271/171 |
| 6,412,773 | B1 * | 7/2002 | Takagi | 271/171 |
| 7,547,014 | B2 | 6/2009 | Okuda et al. | |
| 7,631,861 | B2 * | 12/2009 | Takahashi | 271/9.09 |
| 2006/0071388 | A1 | 4/2006 | Okuda et al. | |
| 2006/0180998 | A1 * | 8/2006 | Lee et al. | 271/171 |
| 2007/0164502 | A1 * | 7/2007 | Komai | 271/145 |
| 2009/0140485 | A1 | 6/2009 | Okuda et al. | |

FOREIGN PATENT DOCUMENTS

| | | |
|---|---|---|
| JP | 62-014172 | 1/1987 |
| JP | 06-127058 | 5/1994 |
| JP | 10-329951 | 12/1998 |
| JP | 2001-080754 | 3/2001 |
| JP | 2002-347950 | 12/2002 |
| JP | 2002-347955 | 12/2002 |
| JP | 2005-178946 | 7/2005 |
| JP | 2006-89278 | 4/2006 |
| JP | 2006-256774 | 9/2006 |
| JP | 2007-191269 | 8/2007 |
| JP | 2007-223789 | 9/2007 |
| JP | 2008-030902 | 2/2008 |

* cited by examiner

*Primary Examiner* — Kaitlin Joerger
*Assistant Examiner* — Prasad V Gokhale
(74) *Attorney, Agent, or Firm* — Morgan, Lewis & Bockius LLP

(57) ABSTRACT

A sheet feeding apparatus includes: a transporting unit that transports a sheet; guiding members that regulate side portions, in a sheet transporting direction, of the sheet, and that guide the sheet being transported; a distance changing member that is configured to be movable, that is coupled with the guiding members, and that changes a distance between the guiding members; and a restricting unit that restricts movement of the distance changing member in conjunction with a transporting operation of the transporting unit.

12 Claims, 8 Drawing Sheets

SHEET FEEDING APPARATUS, IMAGE PROCESSOR AND SHEET FEEDING METHOD

CROSS REFERENCE TO RELATED APPLICATIONS

This application is based on and claims priority under 35 USC §119 from Japanese Patent Application No. 2008-294511 filed Nov. 18, 2008.

BACKGROUND

1. Technical Field

The present invention relates to a sheet feeding apparatus, an image processor and a sheet feeding method.

2. Related Art

There has been conventionally known a paper feeding apparatus that feeds paper sheets toward an image reading position, an image transferring position or the like. This paper feeding apparatus is generally provided with a guiding member that guides paper sheets for the purposes of positioning the paper sheets, preventing diagonal feed of the paper sheets, and the like.

SUMMARY

According to an aspect of the present invention, there is provided a sheet feeding apparatus including: a transporting unit that transports a sheet; guiding members that regulate side portions, in a sheet transporting direction, of the sheet, and that guide the sheet being transported; a distance changing member that is configured to be movable, that is coupled with the guiding members, and that changes a distance between the guiding members; and a restricting unit that restricts movement of the distance changing member in conjunction with a transporting operation of the transporting unit.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below with reference to the accompanying drawings.

Figure 1:
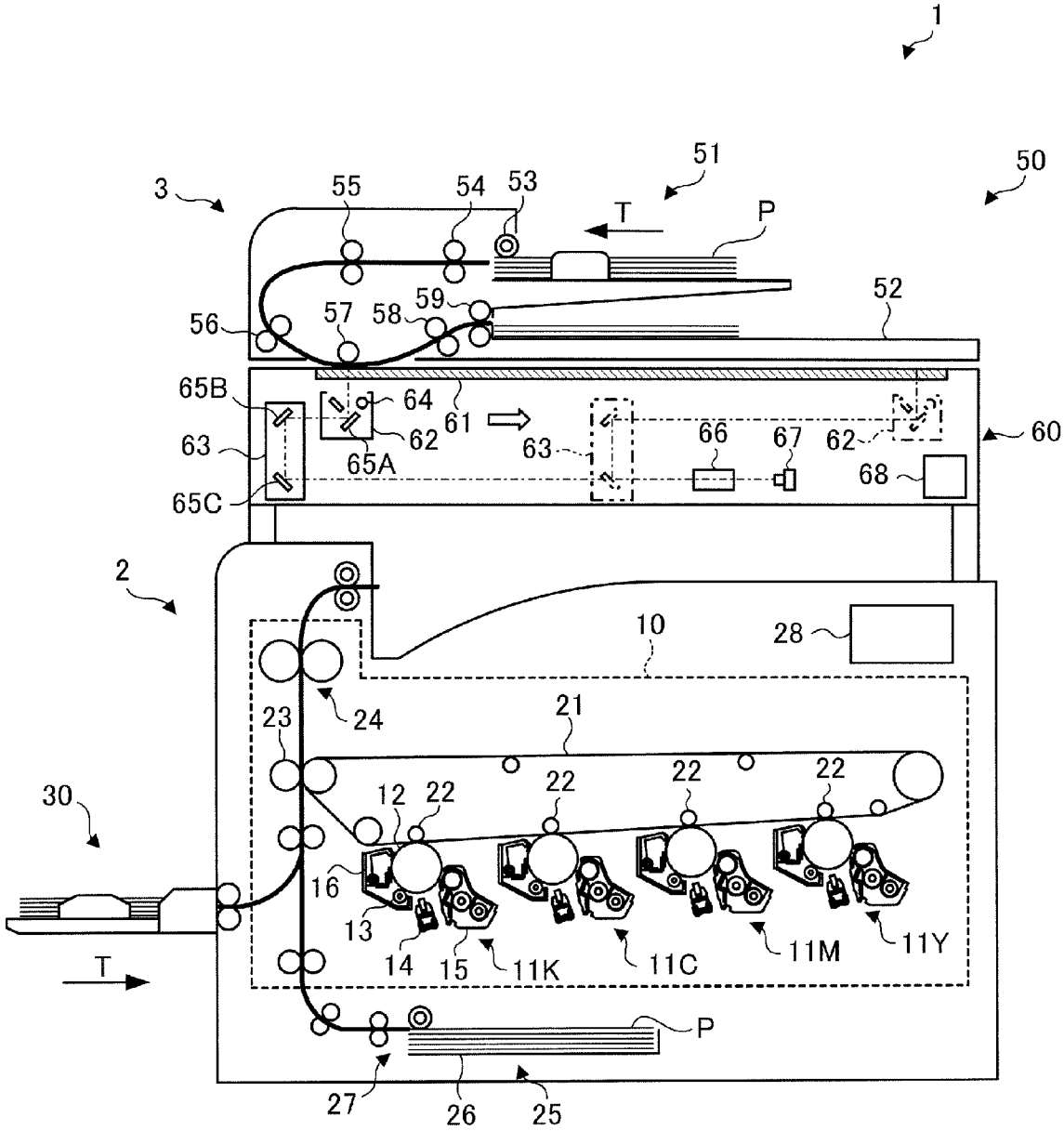
FIG. 1 is a view showing an entire configuration of an image processor of the exemplary embodiment.

FIG. 1 is a view showing an entire configuration of an image processor 1 of the present exemplary embodiment.

The image processor 1 shown in FIG. 1 is a multifunctional apparatus complexly including a copying function, a printing function and the like, and is configured by including an image forming apparatus 2 and a scanner apparatus 3.

The image forming apparatus 2 includes an electrophotographic image forming process unit 10 that performs image formation corresponding to image data of each color. Additionally, the image forming apparatus 2 includes a sheet feeding unit 25 and a manual sheet feeding unit 30 each supplying sheets P toward the image forming process unit 10.

The scanner apparatus 3 includes: a sheet transport unit 50 that transports the sheets P; and an image reading unit 60 that reads images on the sheets P. The scanner apparatus 3 reads images on the sheets P to generate image data, and transmits the generated image data to the image forming apparatus 2 and the like.

As shown in FIG. 1, the image forming process unit 10 includes four image forming units 11Y, 11M, 11C and 11K (which will be collectively referred to as image forming units 11 hereinafter) arranged in parallel at regular intervals and respectively corresponding to yellow (Y), magenta (M), cyan (C) and black (B). Each of the image forming units 11 includes: a photoconductor drum 12 that forms an electrostatic latent image and that retains a toner image; a charging device 13 that electrically charges a surface of the photoconductor drum 12; and an exposing device 14 that exposes on the basis of image data the photoconductor drum 12 electrically charged by the charging device 13. Furthermore, each of the image forming units 11 includes: a developing device 15 that develops the electrostatic latent image formed on the photoconductor drum 12; and a cleaner 16 that cleans the surface of the photoconductor drum 12 after the image is transferred therefrom.

Furthermore, the image forming process unit 10 includes: an intermediate transfer belt 21 to which tonner images of each color formed in the photoconductor drums 12 of the respective image forming units 11 are transferred in a superimposed fashion; a primary transfer roll 22 that sequentially transfers (primarily transfers) the respective color toner images formed in the respective image forming units 11 onto the intermediate transfer belt 21; a secondary transfer roll 23 that collectively transfers (secondarily transfers) onto the sheets P the superimposed toner images transferred onto the intermediate transfer belt 21; and a fixing device 24 that fixes the secondarily transferred images onto the sheets P.

The sheet feeding unit 25 includes: a sheet storage unit 26 that stores a bundle of sheets; and a transporting unit 27 that transports the sheets P. The sheet feeding unit 25 sequentially picks up the sheets P from the bundle of sheets stored in the sheet storage unit 26, and supplies the sheets P toward a secondary transfer position in the image forming process unit 10.

A controller 28 performs: receiving of image data from an external apparatus such as a personal computer (PC) via a network such as a local area network (LAN); image processing for applying processes set in advance to image data or the like transferred from the scanner apparatus 3; and the like. Additionally, the controller 28 controls the image forming process unit 10, the respective rolls and the like. The above-mentioned functions in this controller 28 are implemented by a CPU and the like that are controlled according to a program.

Incidentally, the image forming apparatus 2 of the present exemplary embodiment is a so-called color printer that forms images of colors Y, M, C and K on the sheets P. However, the image forming apparatus 2 is not limited to a color printer.

The image forming apparatus 2 may be, for example, a so-called monochrome printer that forms monochrome images on the sheets P.

Figure 2:
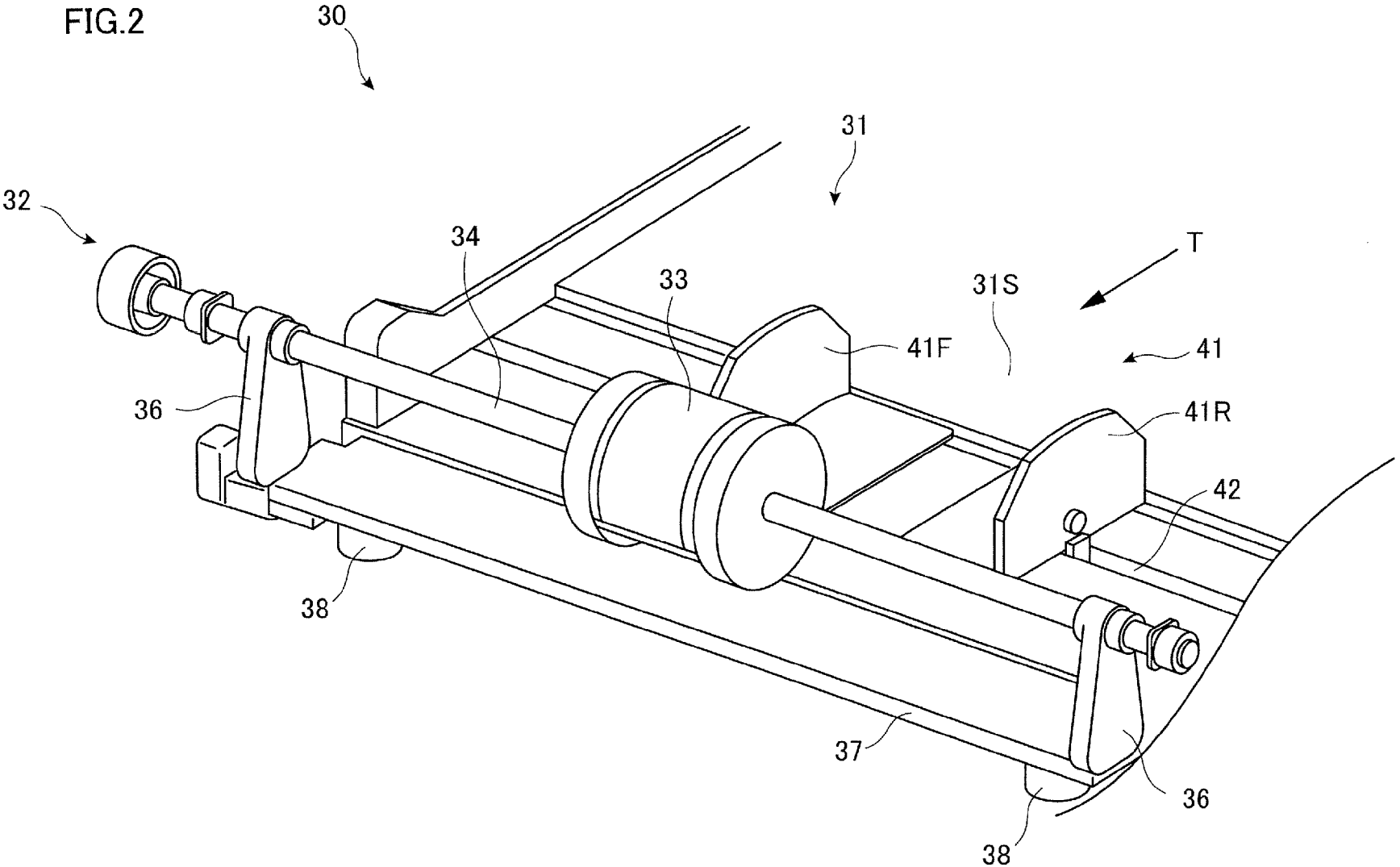
FIG. 2 is a view for explaining the manual sheet feeding unit.

FIG. 2 is a view for explaining the manual sheet feeding unit 30.

As shown in an example of FIG. 2, the manual sheet feeding unit 30 includes: a sheet supplying unit 31 on which the sheets P are supplied; and a transporting unit 32 that transports the sheets P stacked on the sheet supplying unit 31. The sheet supplying unit 31 includes: a sheet supplying face 31S on which the sheets P are stacked; and a guiding unit 41 that positions, for example, the sheets P in a direction (hereinafter, referred to as a sheet width direction) perpendicular (angled at minus 90 degrees and 90 degrees) to a sheet transporting direction T of the sheets P. The manual sheet feeding unit 30 supplies the sheets P stacked on the manual sheet feeding unit 30 toward the image forming process unit 10.

The transporting unit 32 includes: a pickup roll 33, a pickup roll shaft 34 and a bottom plate 37.

The pickup roll 33 is a roll member that rotates in the sheet transporting direction T. The pickup roll 33 is fixed to the pickup roll shaft 34. Additionally, an unillustrated rotation driving unit is coupled with an end of the pickup roll shaft 34. Consequently, when the pickup roll shaft 34 is driven by the rotation driving unit to rotate, the pickup roll 33 rotates in conjunction therewith. Then, the pickup roll 33 comes into contact with the sheets P stacked on the sheet supplying unit 31, and transports the sheets P to the downstream side in the transporting direction. Note that the transporting unit 32 of the present exemplary embodiment is set to transport one of the sheets P every time the pickup roll 33 makes a rotation.

As shown in the example of FIG. 2, cams 36 are provided to both end portions of the pickup roll shaft 34. Each of the cams 36 has one end fixed to the pickup roll shaft 34, and has the other end having a shape extending in a direction going away from the pickup roll shaft 34. These cams 36 rotate in conjunction with rotation of the pickup roll shaft 34. The cams 36 operate lifting and lowering a bottom plate 37 by rotating along with the pickup roll shaft 34. The bottom plate 37 will be described later.

The bottom plate 37 is a rectangular member formed to extend in the sheet width direction as shown in the example of FIG. 2. Additionally, the bottom plate 37 is provided so as to face the pickup roll 33 at a downstream side of the sheet supplying face 31S in the sheet transporting direction. Furthermore, pushing springs 38 are attached to both end portions of a back face side (a side on which the sheets P are not stacked) of the bottom plate 37.

The bottom plate 37 receives force toward the pickup roll 33 from the pushing springs 38 attached to the back face side thereof. Additionally, the bottom plate 37 is configured to come into contact with the cams 36 at timing set in advance. Here, when coming into contact with the cams 36, the bottom plate 37 moves in a direction going away from the pickup roll 33 (hereinafter, this movement will be referred to as "lowering the bottom plate 37"). On the other hand, when being not in contact with the cams 36, the bottom plate 37 receives force from the pushing springs 38 and moves in a direction approaching the pickup roll 33 (hereinafter, this movement will be referred to as "lifting the bottom plate 37").

Additionally, the bottom plate 37 includes a block portion 39 configured to project into a back face side of the sheet supplying face 31S (refer to FIG. 3 which will be explained later). When the bottom plate 37 lowers, the block portion 39 projects into the back face side of the sheet supplying face 31S. On the other hand, when the bottom plate 37 lifts, the block portion 39 retreats from the back face side of the sheet supplying face 31S, and does not project into the back face side of the sheet supplying face 31S.

The guiding unit 41, as one example of the guiding member, includes a first guide 41F and a second guide 41R as shown in FIG. 2. Each of the first and second guides 41F and 41R is a plate member standing up from the sheet supplying face 31S. The first and second guides 41F and 41R are arranged respectively at both end portions of the sheets P stacked on the sheet supplying face 31S. The guiding unit 41 sandwiches the sheets P stacked on the sheet supplying face 31S in the sheet width direction, by use of the first and second guides 41F and 41R. Thereby the guiding unit 41 positions the sheets P, guides the sheets P to be transported, and the like.

Incidentally, in order to prevent diagonal feed of sheets in a feeding apparatus or the like, it is considered that force with which the guiding unit 41 holds sheets is strengthened by setting the guiding unit 41 difficult to move. However, if the guiding unit 41 is made difficult to move, operability is deteriorated when a user or the like tries to move the guiding unit 41. In contrast, if the guiding unit 41 is made easy to move in order to improve operability for the user or the like, force with which the guiding unit 41 holds sheets is weakened when the sheets are transported. To address this, the following configuration is employed in the exemplary embodiment of the present invention.

Figure 3:
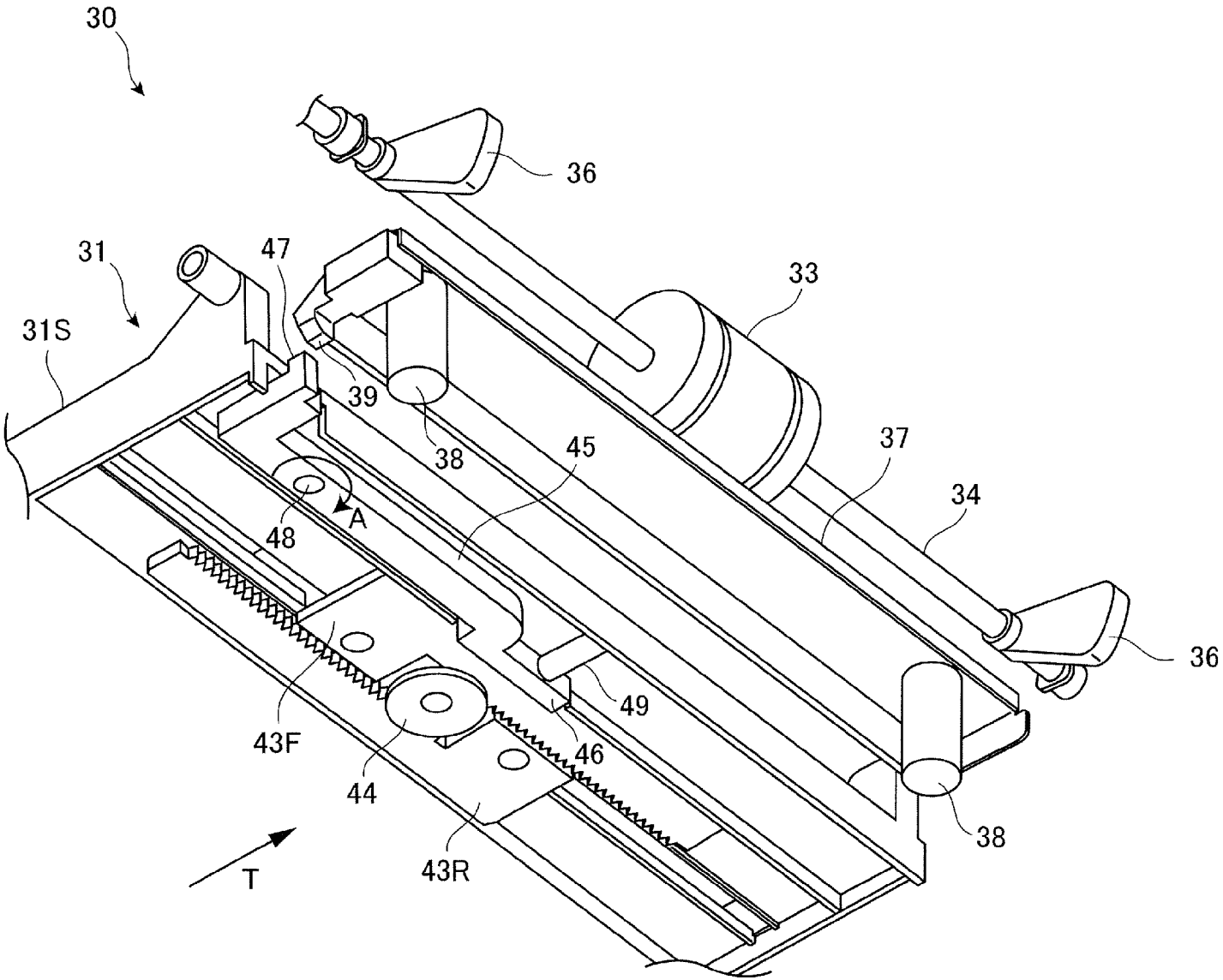
FIG. 3 is a view showing a back face side of the manual sheet feeding unit.

FIG. 3 is a view showing a back face side of the manual sheet feeding unit 30.

The sheet supplying unit 31 includes a first rack 43F, a second rack 43R, and a pinion gear 44, all of which are arranged to the back face side of the sheet supplying face 31S.

As shown in an example of FIG. 3, the pinion gear 44 is attached to the back face side of the sheet supplying face 31S. The first and second racks 43F and 43R are arranged so as to interpose the pinion gear 44 therebetween. Additionally, the first rack 43F is coupled, by use of a coupling member passing through a sliding groove 42 (refer to FIG. 2), with the first guide 41F provided to the sheet supplying face 31S side. Likewise, the second rack 43R is coupled, by use of a coupling member passing through the sliding groove 42, with the second guide 41R provided to the sheet supplying face 31S side.

In the sheet supplying unit 31 of the present exemplary embodiment, the first and second racks 43F and 43R move in conjunction with each other through the pinion gear 44. For example, when the first rack 43F is caused to slide in one direction, the second rack 43R moves in conjunction therewith in a direction opposite to the one direction. When the second rack 43R is caused to move in one direction, the first rack 43F moves likewise. That is, the first and second racks 43F and 43R have a relationship where moving directions thereof are opposite to each other. Additionally, at this time, the first and second racks 43F and 43R move by the same distance. Note that, in the present exemplary embodiment, the first and second racks 43F and 43R and the pinion gear 44 function as one example of the distance changing member.

As described above, the first guide 41F and the second guide 41R are coupled with the first rack 43F and to the second rack 43R, respectively. Consequently, when either one of the first guide 41F and second guide 41R is moved in one direction, the other one thereof moves in a direction opposite to the one direction by the same distance as the one thereof is thus moved.

The guiding unit 41 configured as above is capable to position the sheets P regardless of the size thereof so as to adjust a center part of the sheets P to a position set in advance on the sheet supplying unit 31 by causing the first guide 41F or the second guide 41R to slide. That is, a so-called center registration system is employed for the manual sheet feeding unit 30 in the present exemplary embodiment.

Next, a guide regulating mechanism that regulates the guiding unit 41 of the manual sheet feeding unit 30 will be described.

As shown in FIG. 3, the guide regulating mechanism in the manual sheet feeding unit 30 includes a lever member 45, a rotation shaft 48 and a pushing spring 49.

The lever member 45, which functions as one example of the restricting unit, is a rod-like member extending in one direction, and is attached with the rotation shaft 48 to the back face side of the sheet supplying face 31S. A rack contacting portion 46 and a block receiving portion 47 are provided to one and the other end sides of the lever member 45, respectively. Additionally, the pushing spring 49 is attached to the lever member 45.

The pushing spring 49 has one end side fixed to a side, not facing the first rack 43F, of the rack contacting portion 46, and has the other end side fixed to a housing of the sheet supplying unit 31. The pushing spring 49 applies force, to the lever member 45, in a direction pressing the rack contacting portion 46 side of the lever member 45 to the first rack 43F. That is, the pushing spring 49 applies force rotating the lever member 45 around the rotation shaft 48 in an arrow A direction in FIG. 3.

The rack contacting portion 46 is provided so as to face a side face of the first rack 43F. The rack contacting portion 46 contacts with the first rack 43F when the lever member 45 rotates in the arrow A direction. Then, the rack contacting portion 46 generates frictional force between itself and the first rack 43F. Here, the rack contacting portion 46 of the present exemplary embodiment may be formed of a material such as rubber, for example, having a large friction coefficient with respect to the first rack 43F.

When the above described block portion 39 projects into the back face side of the sheet supplying face 31S, the block receiving portion 47 is got in contact with the block portion 39. The block receiving portion 47, coming into contact with the block portion 39, acts against rotational force generated in the arrow A direction in the lever member 45 by the pushing spring 49. Thereby, the block receiving portion 47 hinders the rack contacting portion 46 and the first rack 43F from coming into contact with each other.

In the example shown in FIG. 3, as mentioned above, the block receiving portion 47 is provided in the lever member 45 in the one end portion opposite to the rack contacting portion 46. However, the block receiving portion 47 may be provided in any position in the lever member 45 as long as the block receiving portion 47 is allowed to act against the rotational force generated in the lever member 45. Note that, in the present exemplary embodiment, the lever member 45 functions as one example of the operation converting unit and as one example of the transmitting unit.

Next, the scanner apparatus 3 will be described with reference to FIG. 1.

The sheet transport unit 50, which functions as one example of the transporting unit, includes: a sheet supplying unit 51 on which a sheet bundle formed of the plural sheets P is supplied; and an outputted-sheet stacking unit 52, provided under the sheet supplying unit 51, on which the sheets P having finished being read are stacked. Additionally, the sheet transport unit 50 includes a pickup roll 53 that picks up the sheets P stacked on the sheet supplying unit 51. Furthermore, a separating unit 54 that separates the sheets P into individual sheets by use of a feed roll and a retard roll is provided at a downstream side of the pickup roll 53 in the sheet transporting direction.

The sheet transport unit 50 is provided with, in a transporting route through which the sheets P are transported, pre-registration rolls 55, registration rolls 56, a platen roll 57, out rolls 58 and exit rolls 59 in this order from an upstream side of the sheet transporting direction.

The pre-registration rolls 55 transport sheets, which have been separated into individual sheets, toward the downstream rolls, and perform loop formation on the sheets P. The registration rolls 56 supply the sheets P toward a later-described image reading unit 60 while applying registration adjustment to the sheets P. The platen roll 57 stabilizes transportation of sheets during image reading by the image reading unit 60. The out rolls 58 transport, further to the downstream side, the sheets P having been read by the image reading unit 60. Additionally, the exit rolls 59 that output the sheets P to the outputted-sheet stacking unit 52 are provided more downstream side of the sheet transporting direction than the out rolls 58.

Here, the above-mentioned various rolls are respectively fitted to rotating shafts, and are configured to rotate by being driven by unillustrated rotation driving units. Additionally, in the present exemplary embodiment, a single rotation driving unit is connected to, for example, a rotating shaft of the pickup roll 53 and to an exit roll shaft 59S (refer to FIG. 5 explained later) serving as a rotating shaft of one of the exit rolls 59. Consequently, if the rotating shaft of the pickup roll 53 is rotated when the sheets P are picked up by the pickup roll 53, the exit roll shaft 59S also rotates. Thus, the present exemplary embodiment simplifies an apparatus configuration by having a rotation driving unit shared among various rolls such as the pickup roll 53 and the exit rolls 59. Note that, in the present exemplary embodiment, the exit roll shaft 59S functions as one example of the rotating member.

The image reading unit 60 reads images from the sheets P transported by the sheet transport unit 50. The image reading unit 60 includes: a platen glass 61 on which each of the sheets P is placed in a stationary state when being read; a full-rate carriage 62 that reads images while resting under the platen glass 61, or scanning entirely across the platen glass 61; and a half-rate carriage 63 that supplies an imaging unit with light obtained from the full-rate carriage 62.

The full-rate carriage 62 is provided with a light source 64 that irradiates light toward the sheet P, and a first mirror 65A that receives the reflected light obtained from the sheet P. Meanwhile, the half-rate carriage 63 is provided with a second mirror 65B and a third mirror 65C which supply the imaging unit with light obtained from the first mirror 65A.

Additionally, the image reading unit 60 includes: an imaging lens 66 and a CCD image sensor 67. Among them, the imaging lens 66 optically reduces a size of an optical image obtained from the third mirror 65C. The CCD image sensor 67 photoelectrically converts an optical image formed by the image forming lens 66.

Additionally, the scanner apparatus 3 includes a scanner controller 68. The scanner controller 68 performs control of each portion of the image reading unit 60 in image reading operations, processing of read image data, and the like. The above-mentioned functions in the scanner controller 68 are implemented by a CPU and the like that are controlled according to a program.

Figure 4:
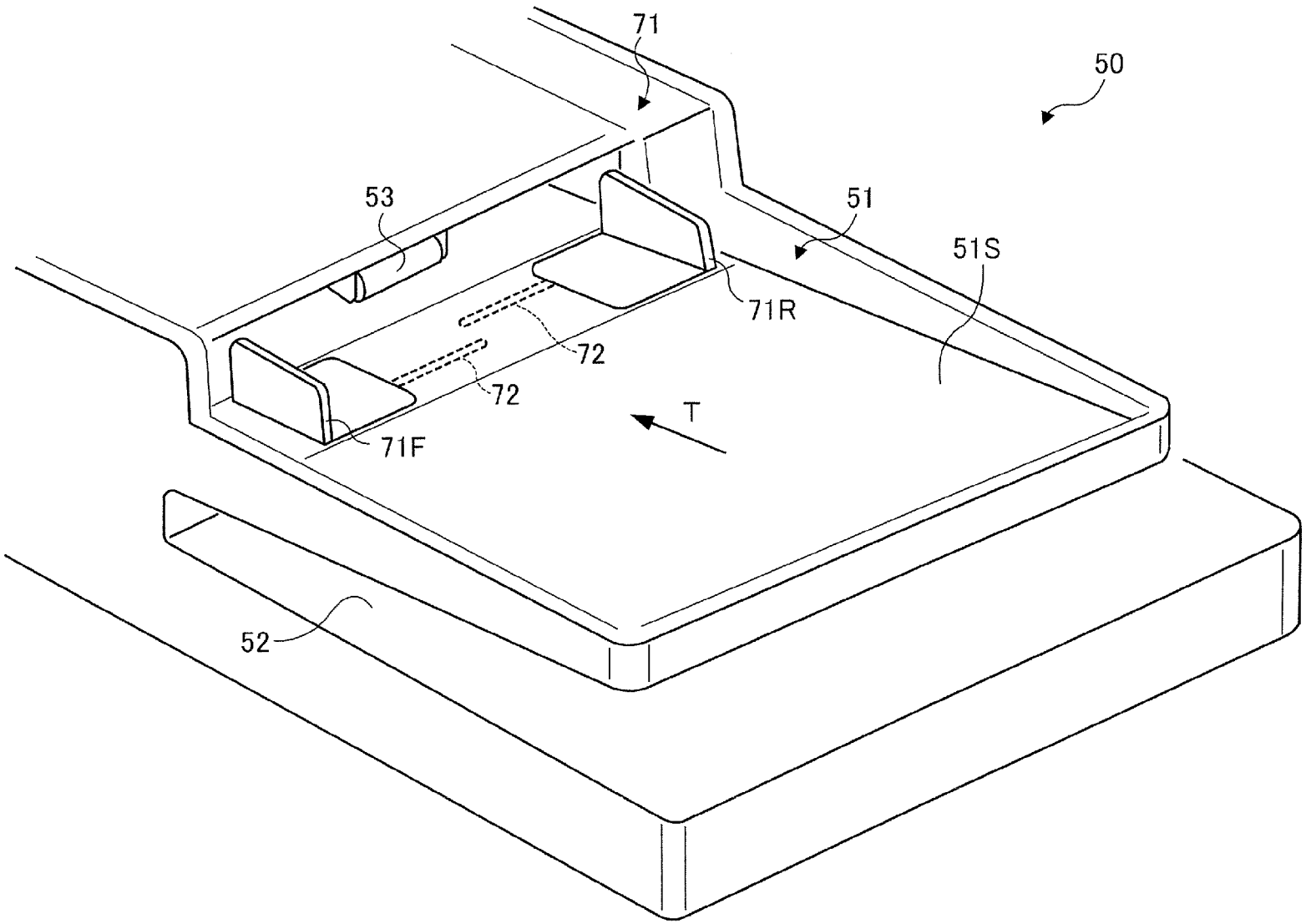
FIG. 4 is a view for explaining the sheet supplying unit in the sheet transport unit.

FIG. 4 is a view for explaining the sheet supplying unit 51 in the sheet transport unit 50.

As shown in FIG. 4, the sheet supplying unit 51 includes: a sheet supplying face 51S on which the sheets P are stacked; and a guiding unit 71 that performs positioning in the sheet width direction, and the like.

The guiding unit 71, as one example of the guiding member, includes a first guide 71F and a second guide 71R as shown in FIG. 4. Each of the first and second guides 71F and 71R is a plate member standing up from the sheet supplying face 51S. The first and second guides 71F and 71R are arranged respectively at both end portions of the sheets P stacked on the sheet supplying face 51S. The guiding unit 71 sandwiches the sheets P, stacked on the sheet supplying face 51S, in the sheet width direction by use of the first and second guides 71F and 71R. Thereby the guiding unit 71 positions the sheets P, guides the sheets P to be transported, and the like.

Figure 5:
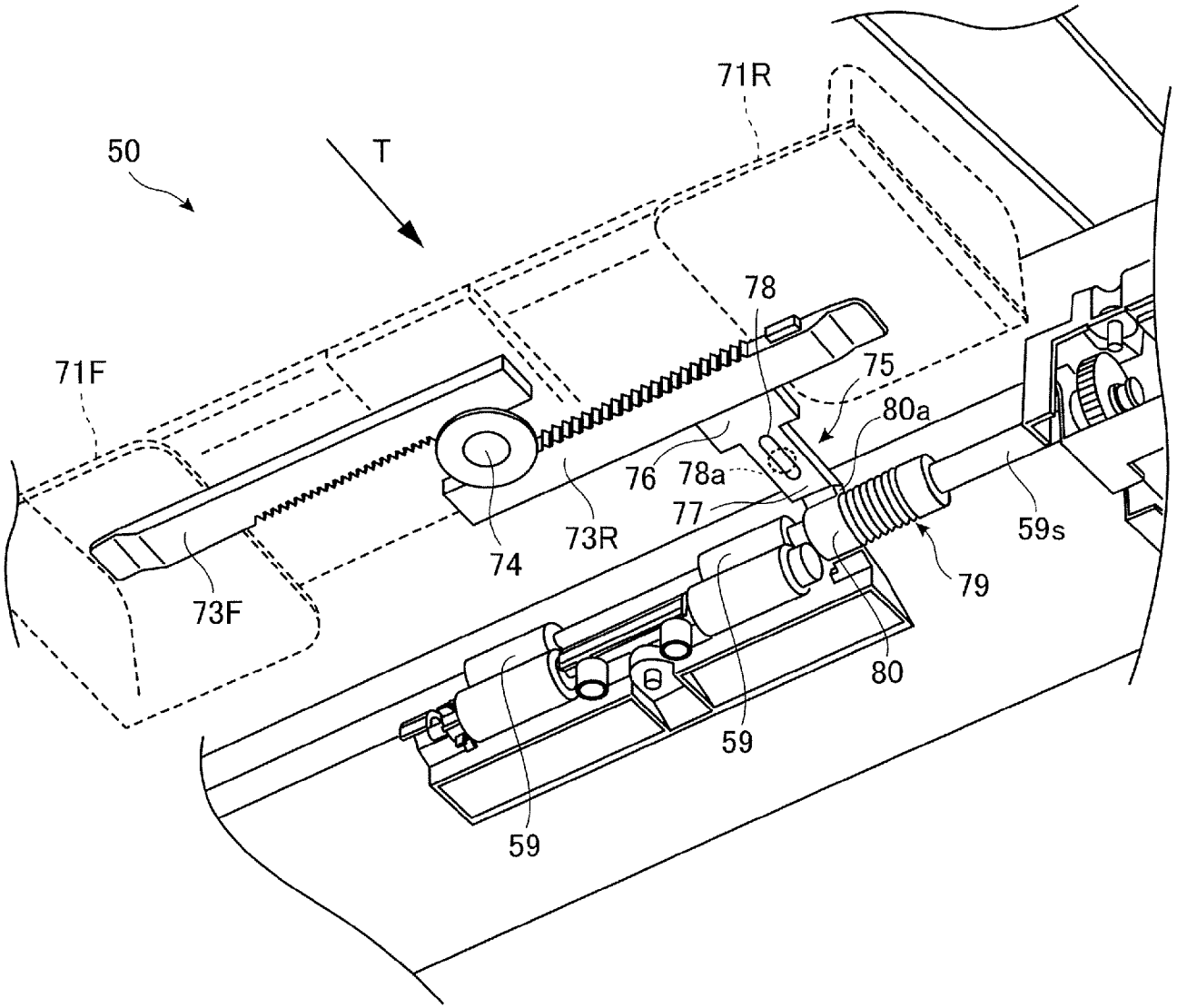
FIG. 5 is a view showing a back face side of the sheet supplying face of the sheet transport unit.

FIG. 5 is a view showing a back face side of the sheet supplying face 51S of the sheet transport unit 50.

The sheet supplying unit 51 includes a first rack 73F, a second rack 73R, and a pinion gear 74, all of which are arranged to the back face side of the sheet supplying face 51S.

As shown in FIG. 5, the pinion gear 74 is attached to the back face side of the sheet supplying face 51S. The first and second racks 73F and 73R are arranged so as to interpose the pinion gear 74 therebetween. Additionally, the first rack 73F is coupled, by use of a coupling member passing through a sliding groove 72 (refer to FIG. 4), with the first guide 71F provided to the sheet supplying face 51S side. Likewise, the second rack 73R is coupled, by use of a coupling member passing through the sliding groove 72, with the second guide 71R provided to the sheet supplying face 51S side.

In the sheet supplying unit 51 of the present exemplary embodiment, the first and second racks 73F and 73R move in conjunction with each other through the pinion gear 74. For example, when the first rack 73F is caused to slide in one direction, the second rack 73R moves in conjunction therewith in a direction opposite to the one direction. When the second rack 73R is caused to move in one direction, the first rack 73F moves likewise. That is, the first and second racks 73F and 73R have a relationship where moving directions thereof are opposite to each other. Additionally, at this time, the first and second racks 73F and 73R move by the same distance. Note that, in the present exemplary embodiment, the first and second racks 73F and 73R and the pinion gear 74 function as one example of the distance changing member.

As described above, the first guide 71F and the second guide 71R are coupled with the first rack 73F and to the second rack 73R, respectively. Consequently, when either one of the first guide 71F and second guide 71R is moved in one direction, the other one thereof moves in a direction opposite to the one direction by the same distance as the one thereof is thus moved.

The guiding unit 71 configured as above is capable to position the sheets P regardless of the size thereof so as to adjust a center part of the sheets P to a position set in advance on the sheet supplying unit 51 by causing the first guide 71F or the second guide 71R to slide.

Next, a guide regulating mechanism that regulates the guiding unit 71 of the sheet transport unit 50 will be described.

As shown in FIG. 5, the guide regulating mechanism in the sheet transport unit 50 includes: a stopper member 75 that regulates movement of the guiding unit 71; a torque limiter 79 that controls transmission of rotating torque from the exit roll shaft 59S to an actuator 80; the actuator 80 that transmits force to the stopper member 75.

The stopper member 75, which functions as one example of the restricting unit, is a plate-like member. As shown in an example of FIG. 5, the stopper member 75 includes a rack contacting portion 76 and a receiving portion 77. Furthermore, the stopper member 75 includes, between the rack contacting portion 76 and the receiving portion 77, a long hole 78 extending from the actuator 80 side toward the second rack 73R. The stopper member 75 is attached, by use of a screw 78*a* penetrating this long hole 78, to the back face side of the sheet supplying face 51S so as to be slidable along a longitudinal direction of the long hole 78.

Figure 6:
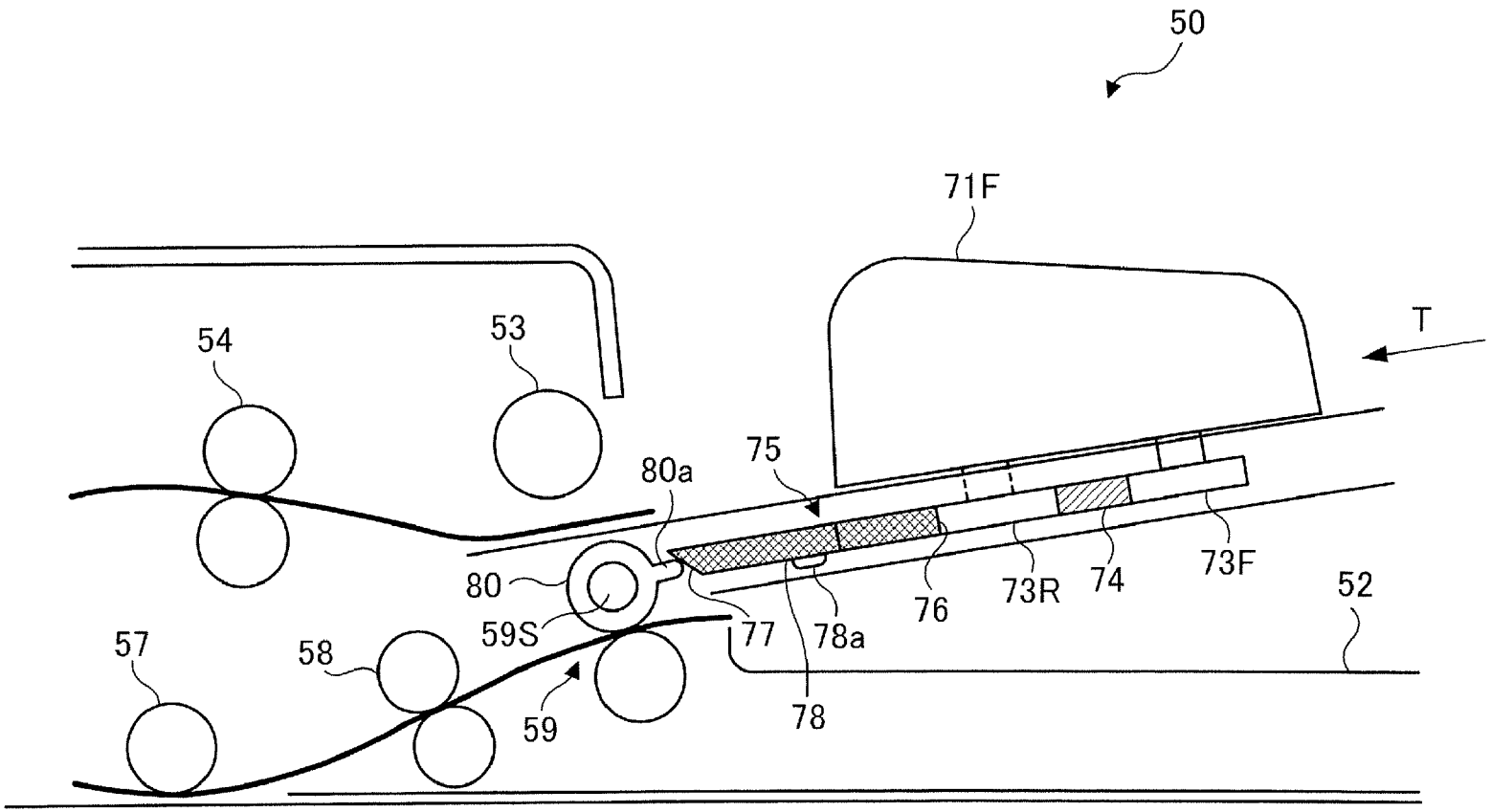
FIG. 6 is a view showing a side view of the sheet transport unit.

FIG. 6 is a view showing a side view of the sheet transport unit 50.

The rack contacting portion 76 is provided so as to face a side face of the second rack 73R. As shown in FIG. 6, the rack contacting portion 76 contacts with the second rack 73R when the stopper member 75 moves. Then, the rack contacting portion 76 generates frictional force between itself and the second rack 73R. Here, the rack contacting portion 76 of the present exemplary embodiment may be formed of a material such as rubber, for example, having a large friction coefficient with respect to the second rack 73R.

The receiving portion 77 is got in contact with a projecting portion 80*a* of the later-described actuator 80. Thereby, the receiving portion 77 converts rotating torque held by the actuator 80 into moving force of the stopper member 75. The receiving portion 77 of the present exemplary embodiment has a tapered shape as shown in an example of FIG. 6. By thus forming the receiving portion 77 in a tapered shape, the receiving portion 77 receives rotation of the actuator 80, and converts force received from the actuator 80 into a component in a moving direction of the stopper member 75.

The torque limiter 79 is attached to the exit roll shaft 59S (refer to FIG. 5). Furthermore, the torque limiter 79 is connected to the actuator 80. Thereby, the torque limiter 79 controls transmission of rotating torque from the exit roll shaft 59S to the actuator 80. Note that any one of various torque limiters of an OTLC type and the like may be used as the torque limiter 79 of the present exemplary embodiment.

The actuator 80 is rotatably attached to the exit roll shaft 59S as shown in the example of FIG. 6. Furthermore, the actuator 80 is connected to the torque limiter 79. The actuator 80 receives rotating torque from the exit roll shaft 59S through the torque limiter 79. As shown in the example of FIG. 6, the actuator 80 of the present exemplary embodiment is provided with the projecting portion 80*a* projecting in a radial direction of the actuator 80. The actuator 80 contacts with the receiving portion 77 of the stopper member 75 through this projecting portion 80*a*. The actuator 80 configured as above comes into contact with the receiving portion 77 of the stopper member 75 and pushes the stopper member 75 to the second rack 73R side. Note that, in the present exemplary embodiment, the stopper member 75 and the actuator 80 function as one example of the operation converting unit or the transmitting unit.

Next, image forming operations of the image forming apparatus 2 will be described.

Figure 7A:
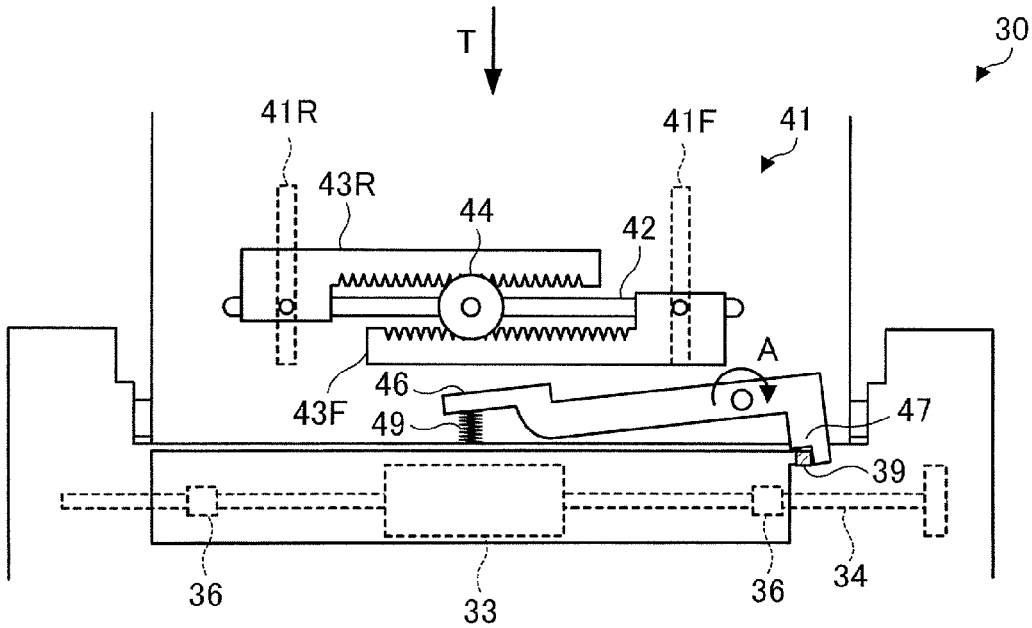
FIGS. 7A and 7B are views for explaining operations of a lever portion in the manual sheet feeding unit.
Figure 7B:
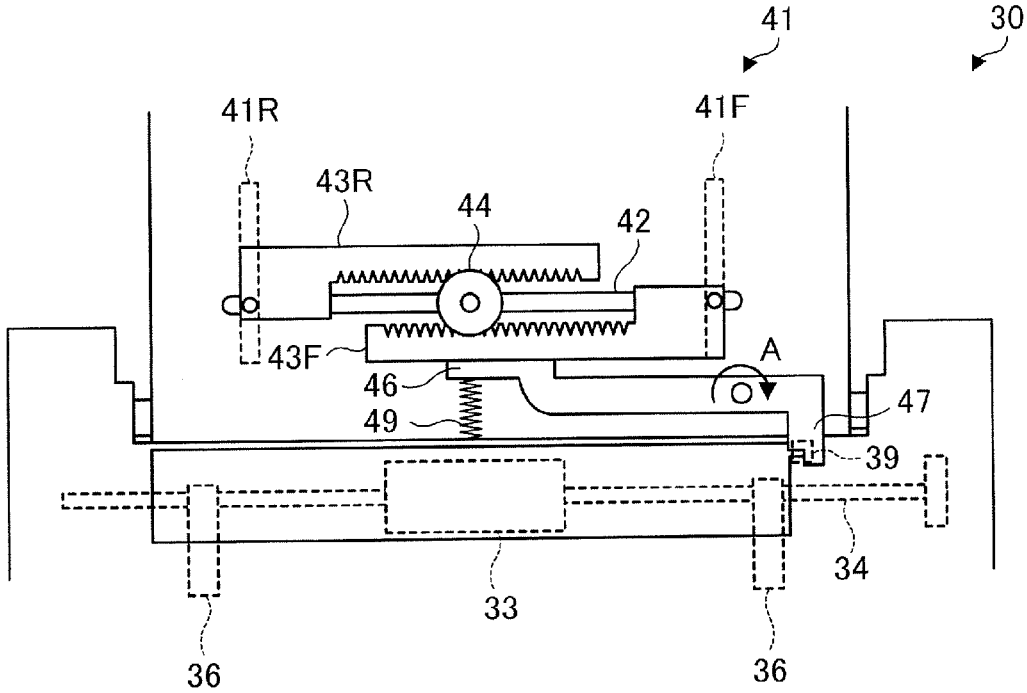

FIGS. 7A and 7B are views for explaining operations of a lever portion in the manual sheet feeding unit 30.

Hereinafter, a case in which images are formed on the sheets P stacked on the manual sheet feeding unit 30 will be described.

Until the image formation is started, the manual sheet feeding unit 30 maintains a state where the bottom plate 37 (refer to FIG. 3) is lowered, that is, a state where the cams 36 come into contact with the bottom plate 37. Thereby, space into which each of the sheets P is inserted is secured between the bottom plate 37 and the pickup roll 33. Additionally, in the state where the bottom plate 37 is lowered, the block portion 39 provided to the bottom plate 37 projects into the back face side of the sheet supplying face 31S.

In this state, the block portion 39 inevitably contacts with the block receiving portion 47 of the lever member 45 as shown in an example of FIG. 7A. Then, the block portion 39 acts against force with which the pushing spring 49 tries to make the lever member 45 rotate in an arrow A direction. Thereby, the rack contacting portion 46 of the lever member 45 is not in contact with the first rack 43F. Consequently, a state is maintained where the first rack 43F is movable without receiving frictional force from the rack contacting portion 46.

As described above, until transportation of the sheets P is started in the manual sheet feeding unit 30, a state is maintained where the guiding unit 41 (the first guide 41F or the second guide 41R) is easy to move. Thus, the present exemplary embodiment enhances operability of the guiding unit 41 when the user or the like tries to move the guiding unit 41. Note that the above-mentioned state of the lever member 45 maintained until transportation of the sheets P is started corresponds to one example of the first state.

Then, upon receiving an instruction to start image formation, processing is executed in the respective units. The color toner images formed in the respective image forming units 11 are electrostatically transferred in a sequential manner onto the intermediate transfer belt 21 by the primary transfer rolls 22. Along with movement of the intermediate transfer belt 21, the superimposed toner images on the intermediate transfer belt 21 are transported to a secondary transfer unit in which the secondary transfer roll 23 is arranged. After the superimposed toner images are transported to the secondary transfer unit, the sheets P are transported from the manual sheet feeding unit 30 toward a secondary transfer position (an image forming position) so that timing of the transportation may match timing of the transportation of the toner images to the secondarily transferring unit.

At this time, in the manual sheet feeding unit 30, the unillustrated rotation driving unit rotates the pickup roll shaft 34. Along with the rotation of the pickup roll shaft 34, the pickup roll 33 starts to rotate, and the cams 36 also rotate. Then, the cams 36 come off from the bottom plate 37. As a result, the bottom plate 37 goes into a lifted state by being pushed up by the pushing spring 38 (refer to FIG. 3).

By lifting the bottom plate 37, the block portion 39 retreats from the back face side of the sheet supplying face 31S. Thereby, the block portion 39 comes out of contact with the block receiving portion 47 of the lever member 45 as shown in the example of FIG. 7B. The lever member 45 is rotated in the arrow A direction in the figure by the pushing spring 49 provided to the rack contacting portion 46 side. Then, the rack contacting portion 46 of the lever member 45 comes into contact with the first rack 43F. That is, the first rack 43F is pressed by the rack contacting portion 46 of the lever member 45.

When the first rack 43F tries to move, movement thereof is impeded by frictional force generated between the first rack 43F and the rack contacting portion 46. Furthermore, the first rack 43F moves in conjunction with the second rack 43R through the pinion gear 44. Consequently, movement of the second rack 43R is also impeded while the first rack 43F is being pressed by the rack contacting portion 46. Note that the above-mentioned state of the lever member 45 after the transportation of the sheets P is started corresponds to one example of the second state.

The first rack 43F and the second rack 43R are coupled with the first guide 41F and to the second guide 41R, respectively. Consequently, while the first rack 43F is pressed by the rack contacting portion 46, a state is maintained where the first and second guides 41F and 41R are difficult to move. Thereby, for example, even when the sheets P are about to be transported in a slanted state for some reason, diagonal feed of the sheets P is prevented since both the end portions of the sheets P are regulated by the first and second guides 41F and 41R.

By lifting the bottom plate 37, an end portion in the downstream side of the sheets P in the sheet transporting direction approaches the pickup roll 33. The sheets P come into contact with the pickup roll 33, and are transported in the sheet transporting direction. Then, when the sheets P have been transported to reach the secondary transfer position, the superimposed toner images are electrostatically transferred in a collective manner onto each of the sheets P by the secondary transfer roll 23. Thereafter, the sheet P onto which the superimposed toner images have been electrostatically transferred is separated from the intermediate transfer belt 21, and is transported to the fixing device 24. Furthermore, the superimposed toner images are firmly fixed on the sheet P by being subjected to a fixing process with heat and pressure by the fixing device 24. The sheets P on which firmly fixed images are formed are outputted to a sheet accumulating unit provided in the image forming apparatus 2.

Incidentally, the pickup roll 33 (the pickup roll shaft 34) of the present exemplary embodiment is configured to transport one of the sheets P while making a rotation. That is, when transportation of one of the sheets P is completed, the pickup roll shaft 34 returns to a rotational position before starting the rotation. At this time, the cams 36 are in contact with the bottom plate 37 again, and the bottom plate 37 is in a lowered state. By lowering the bottom plate 37, the block portion 39 and the block receiving portion 47 of the lever member 45 come into contact with each other. Thereby, a rotating operation, caused by the pushing spring 49, of the lever member 45 is impeded, whereby force with which the rack contacting portion 46 of the lever member 45 presses the first rack 43F is removed. Thus, when the transportation of one of the sheets P is completed, the guiding unit 41 again goes into the state where the guiding unit 41 is easy to move in the present exemplary embodiment.

As described above, when being in a state transporting the sheets P, the manual sheet feeding unit 30 of the present exemplary embodiment makes it difficult to move the guiding unit 41 so as to prevent occurrence of diagonal feed of the sheets P. Additionally, when being in a state not transporting the sheets P (in a state where transporting the sheets P is not required), the manual sheet feeding unit 30 makes it easy to move the guiding unit 41 so as to prevent deterioration of operability of the guiding unit 41 for the user or the like.

Next, image reading operations of the scanner apparatus 3 will be described.

Figure 8A:
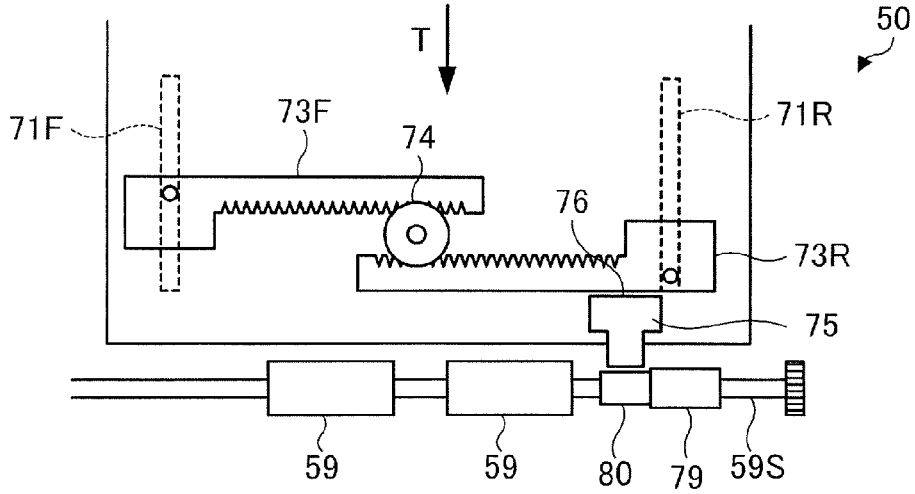
FIGS. 8A to 8C are views for explaining operations of the stopper member in the sheet transport unit.
Figure 8B:
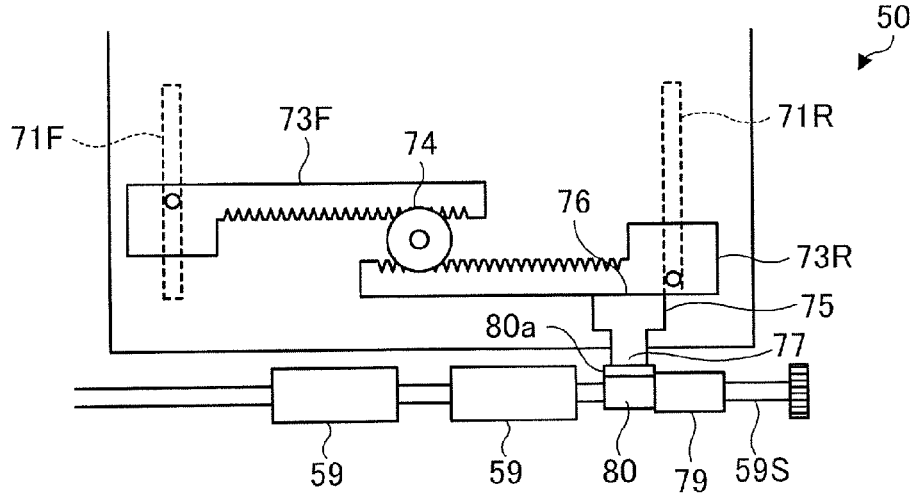
Figure 8C:
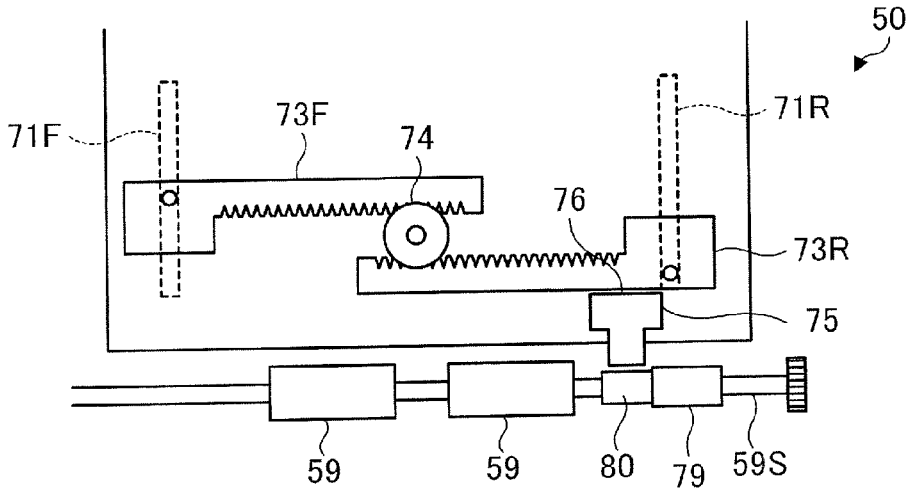

FIGS. 8A to 8C are views for explaining operations of the stopper member 75 in the sheet transport unit 50.

In the sheet transport unit 50, rotation of the pickup roll 53, the exit rolls 59 (exit roll shaft 59S) and the like is stopped until image reading is started. At this time, as shown in FIG. 8A, the projecting portion 80*a* (refer to FIG. 8B) of the actuator 80 is apart from the stopper member 75. In that condition, the second rack 73R does not receive force with which the second rack 73R is pushed by the stopper member 75.

Thus, until transportation of the sheets P is started in the sheet transport unit 50, a state is maintained where the guiding unit 71 (the first guide 71F or the second guide 71R) is easy to move. Thereby, the present exemplary embodiment enhances operability of the guiding unit 71 when the user or the like tries to move the guiding unit 71. Note that the above-mentioned state of the stopper member 75 until the transportation of the sheets P is started corresponds to one example of the first state.

At timing when the reading is started, the respective rolls in the sheet transport unit 50 start to rotate. At this time, in the sheet transport unit 50 of the present exemplary embodiment, a single rotation driving unit is used for driving rotation of the pickup roll 53 that picks up the sheets P, and of the exit rolls 59. Consequently, when the pickup roll 53 is rotated, the exit rolls 59 (the exit roll shaft 59S) also start to rotate.

By the rotation of the exit roll shaft 59S, rotating torque from the exit roll shaft 59S is transmitted to the torque limiter 79. The torque limiter 79 transmits the rotating torque from the exit roll shaft 59S to the actuator 80 until the rotating torque reaches preset torque. Thereby, the actuator 80 starts to rotate. Then, the projecting portion 80*a* of the actuator 80 bumps into the receiving portion 77 of the stopper member 75.

The stopper member 75, after coming into contact with the projecting portion 80*a* of the actuator 80, moves to the second rack 73R side as shown in FIG. 8B. The second rack 73R is pressed by the rack contacting portion 76 of the stopper member 75.

The exit roll shaft 59S further continues rotating. On the other hand, rotation of the actuator 80 connected to the torque limiter 79 is impeded by the stopper member 75. For this reason, after rotating torque acting on the torque limiter 79 reaches preset torque of the torque limiter 79, the torque limiter 79 performs idle rotation while receiving this preset torque. Additionally, the actuator 80 continues to contact with the receiving portion 77 of the stopper member 75 at the preset torque of the torque limiter 79, and the rack contacting portion 76 of the stopper member 75 continues to press the second rack 73R.

Thereby, when the second rack 73R tries to move, movement thereof is impeded by frictional force generated between the second rack 73R and the rack contacting portion 76. Furthermore, the second rack 73R moves in conjunction with the first rack 73F through the pinion gear 74. Consequently, movement of the first rack 73F is also impeded while the second rack 73R is being pressed by the rack contacting portion 76. Note that the above-mentioned state of the stopper member 75 after the transportation of the sheets P is started corresponds to one example of the second state.

The first rack 73F and the second rack 73R are coupled with the first guide 71F, and with the second guide 71R, respectively. Consequently, while the second rack 73R is pressed by the rack contacting portion 76, a state is maintained where the first and second guides 71F and 71R are difficult to move. Thereby, for example, even when the sheets P are about to be transported in a slanted state for some reason, diagonal feed of the sheets P is prevented since the sheets P are held by the first and second guides 71F and 71R.

The sheets P, picked up by the pickup roll 53, are transported and pass over the platen glass 61. At this time, the full-rate carriage 62 and the half-rate carriage 63 stand by in a stopped state at a position indicated by a solid line shown in FIG. 1. Then, the light source 64 irradiates light, and the light is irradiated toward the sheets P. The reflected light reflected on the sheets P is supplied to the imaging lens 66 after passing through the first mirror 65A, the second mirror 65B and the third mirror 65C. Furthermore, the CCD image sensor 67 reads an optical image formed by the imaging lens 66. Scanning as described above is performed in a sub-scan direction of the sheets P, whereby reading one of the sheets P is completed.

The rotation of the exit rolls 59 (the exit roll shaft 59S) stops after one of the sheets P is completely read and outputted to the outputted-sheet stack unit 52. Then, the actuator 80 stops receiving transmission of the rotating torque. Here, the torque limiter 79 of the present exemplary embodiment has an idle rotation backlash (play) of about 10 degrees. Thereby, even when the stopper member 75 moves to the actuator 80 side, an operation of the stopper member 75 is absorbed since the actuator 80 may rotate by an amount corresponding to the idle rotation backlash of the torque limiter 79. Consequently, as shown in FIG. 8C, the second rack 73R is released from the pressing force of the stopper member 75. Thus, in the sheet transport unit 50 of the present exemplary embodiment, the guiding unit 71 again goes into the state where the guiding unit 71 is easy to move, after the sheet P is outputted.

As described above, when transporting the sheets P, the sheet transport unit 50 of the present exemplary embodiment makes it difficult to move the guiding unit 71 so as to prevent occurrence of diagonal feed of the sheets P. Additionally, when not transporting the sheets P, the sheet transport unit 50 makes it easy to move the guiding unit 71 so as to prevent deterioration of operability of the guiding unit 71 for the user or the like.

Note that a system to be employed for the guides in the manual sheet feeding unit 30 and the sheet transport unit 50 is not limited to the center registration system. For example, a side registration system which includes only the first guide 41F may be employed. In this case, a configuration may be employed in which the above described lever member 45 to come into contact with the guiding unit which moves.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding apparatus comprising:

a transporting unit that transports a sheet in a sheet transporting direction;

guiding members that regulate side portions of the sheet that are parallel to the sheet transporting direction, and that guide the sheet being transported;

a distance changing member that is configured to be movable, that is coupled with the guiding members, and that changes a distance between the guiding members; and a restricting unit moves between an engaged position, which restricts movement of the distance changing member in conjunction with a transporting operation of the transporting unit during the transporting operation and a disengaged position, which allows movement of the distance changing member.

2. The sheet feeding apparatus according to claim 1, further comprising an operation converting unit that converts the transporting operation of the transporting unit into an operation by which the restricting unit moves to engage the distance changing member, wherein the restricting unit contacts the distance changing member at the engaged position by moving in accordance with the operation converting unit, and restricts the movement of the distance changing member by friction.

3. The sheet feeding apparatus according to claim 1, further comprising a transmitting unit that transmits force generated by the transporting operation of the transporting unit, wherein the restricting unit restricts the movement of the distance changing member at the engaged position by use of the force that is generated by the transporting operation of the transporting unit and that is transmitted from the transmitting unit.

4. The sheet feeding apparatus according to claim 1, wherein the restricting unit allows movement of the distance changing member at the disengaged position when the transporting unit completes transportation of the sheet.

5. An image processor comprising:

a transporting unit that transports a sheet in a sheet transporting direction toward any one of an image forming position and an image reading apparatus;

guiding members that regulate side portions of the sheet that are parallel to the sheet transporting direction, and that guide the sheet being transported;

a distance changing member that is configured to be movable, that is coupled with the guiding members, and that changes a distance between the guiding members; and a restricting unit moves between an engaged position, which restricts movement of the distance changing member in conjunction with a transporting operation of the transporting unit during the transporting operation and a disengaged position, which allows movement of the distance changing member.

6. The image processor according to claim 5, further comprising an operation converting unit that converts the transporting operation of the transporting unit into an operation by which the restricting unit moves to engage the distance changing member, wherein the restricting unit contacts the distance changing member at the engaged position by moving in accordance with the operation converting unit, and restricts the movement of the distance changing member by friction.

7. The image processor according to claim 6, wherein the transporting unit includes a rotating member that rotates and transports the sheet, and the operation converting unit converts a rotating operation of the rotating member into an operation of moving the restricting unit so as to contact the distance changing member.

8. The image processor according to claim 6, wherein the restricting unit is pressed against the distance changing member at the engaged position, the transporting unit includes a rotating member that rotates and transports the sheet, and the operation converting unit converts a rotating operation of the rotating member into an operation for moving the restricting unit away from the distance changing member at the disengaged position.

9. The image processor according to claim 5, further comprising a transmitting unit that transmits force generated by the transporting operation of the transporting unit, wherein the restricting unit restricts the movement of the distance changing member at the engaged position by use of the force that is generated by the transporting operation of the transporting unit and that is transmitted from the transmitting unit.

10. The image processor according to claim 9, wherein the transporting unit includes a rotating member that rotates and transports the sheet, and the transmitting unit transmits rotating torque of the rotating member to the restricting unit.

11. An image processor comprising:

a transporting unit that transports a sheet in a sheet transporting direction toward any one of an image forming position and an image reading apparatus;

guiding members that regulate side portions of the sheet that are parallel to the sheet transporting direction, and that guide the sheet being transported;

a distance changing member that is configured to be movable, that is coupled with the guiding members, and that changes a distance between the guiding members; and a restricting unit moves between an engaged position, which restricts movement of the distance changing member during transportation of the transporting unit and a disengaged position, which allows movement of the distance changing member.

12. A sheet feeding method of a sheet feeding apparatus including a transporting unit that transports a sheet in a sheet transporting direction, guiding members that regulate side portions of the sheet that are parallel to the sheet transporting direction, and that guide the sheet being transported, a distance changing member that is configured to be movable, that is coupled with the guiding members, and that changes a distance between the guiding members, the sheet feeding method comprising:

restricting movement of the distance changing member in conjunction with a transporting operation of the sheet wherein a restricting unit moves from a disengaged position, which allows movement of the distance changing member, to an engaged position during the transporting operation.

* * * * *